United States Patent [19]

Manhoff, Jr.

[11] Patent Number: 4,526,072

[45] Date of Patent: Jul. 2, 1985

[54] SCREW HOLDING DEVICE

[76] Inventor: Louis J. Manhoff, Jr., R.R. 2, P.O. Box 2078, Bulverde, Tex. 78163

[21] Appl. No.: 524,529

[22] Filed: Aug. 19, 1983

[51] Int. Cl.[3] ..... B25B 15/00

[52] U.S. Cl. ..... 81/451; 81/452

[58] Field of Search ..... 81/452, 451

[56] References Cited

U.S. PATENT DOCUMENTS 3,245,446 4/1966 Morifuji ..... 81/452

4,038,715 8/1977 Litt ..... 15/106

FOREIGN PATENT DOCUMENTS 230189 3/1925 United Kingdom ..... 81/452

*Primary Examiner*—Frederick R. Schmidt

*Assistant Examiner*—J. T. Zatarga

*Attorney, Agent, or Firm*—Cox & Smith Incorporated

[57] ABSTRACT

A screw driving apparatus including a cylindrical tube having a plurality of radial bristles attached to the inner cylinder wall for receiving a driver and a screw to assist in driving the screw and to assist in removing a screw which has been driven.

2 Claims, 5 Drawing Figures

SCREW HOLDING DEVICE

BACKGROUND OF THE INVENTION

Screw holding devices are common tools, used in situations where there is limited room to work, where the screw is likely to be irretrievable if dropped, or in any other situation where the person driving the screw needs help in getting the screw "started", and in driving or removing the screw.

While several devices have been patented which are designed to aid the person driving the screw in the above mentioned situations, the patented devices suffer from several common deficiencies. The patents found which had similar objectives as the invention are U.S. Pat. No. 3,245,446 issued to Morifuji, U.S. Pat. No. 2,954,809 issued to Loewy, and U.S. Pat. No. 2,985,208 issued to Hibbard and Berry. These patents have a number of drawbacks which, if corrected, would greatly enhance the ease with which a screw could be started and the convenience of using the device. All of the patented devices attempt to hold a screw only by its head and put no pressure or constraint on the length of the shaft of the screw, allowing the screw to be dislodged by a sideward displacement. Also, the patented devices hold onto the screwhead by a member that contains one or a few holding elements. This makes it more difficult for the screw to be placed perfectly into the holder in the first place, because the small number of holding elements are bulky and inflexible. Moreover, the patented devices have little tolerance as to the size of the screw that they will hold. Some of the variations of the patented devices require the screw holder to be permanently attached to the screwdriver, which makes the screwdriver more bulky for carrying and storage. The patents which do not have the screw holder permanently attached to the screwdriver require that the screw holder be stored separately from the screw driver, increasing the chance that the holder will be lost or misplaced. The patented devices must also be removed from the screwdriver when not in use, also increasing chances that the device will be misplaced or lost. Finally, existing devices are not practical to use from start to finish in the process of driving a screw or regardless of the tension required to drive the screw. It is believed that the invention solves these problems and the invention is much more different from previously patented devices than the devices are from each other.

SUMMARY OF THE INVENTION

The invention is a cylindrical tube, open at both ends, filled with a large number of small "bristles" which are attached to the cylinder wall and oriented toward the center of the axis of the cylinder. The bristles are sufficiently close together and stiff so that they will hold in place a screw inserted into one end of the cylinder. The tube and bristles may be constructed of a clear material so that the person driving the screw can see when the tip of the screwdriver is in alignment with the head of the screw. The advantages of the invention over prior devices are:

1. The invention holds the entire length of the screw, both the head and the shaft, so that the screw cannot be dislodged by sideward displacement.

2. The screw is held by a large number (up to several hundred) of holding bristles, so that it cannot be dislodged by the imperfect placement of one or a few holding members.

3. The invention has considerable tolerance as to the size of the screw and size of the screwdriver that may be used.

4. The invention holds the screw in perfect alignment with the shaft of the screwdriver and thus in alignment with the driving force of the screwdriver so that it cannot be diverted laterally and cannot be twisted or dislodged.

5. The invention holds the tip of the screwdriver in proper position in contact with the head of the screw so that it will not slide out of the groove or otherwise become disengaged from the screw while driving or removing the screw.

6. The invention is a free standing device and is not permanently attached to the screwdriver.

7. The invention may be stored on the shaft of the screwdriver or separately so that it may be readily placed in use when needed.

8. The invention holds a screw with sufficient tension along its length to be used as a screwdriver itself when the screw is easily driven.

9. The screw and the screwdriver can be inserted in the invention from either end or both from the same end.

10. Both the screwdriver and the screw are held securely in position and alignment by the invention, but either can be manipulated easily so that the screwdriver will seat itself into the slot on the screw head without dislodging the screw.

11. The invention may be used in any application of a screw driving principle, including screwdriver attachments to electric drills.

12. The invention is effective in removing screws as well as driving screws. As the head of the screw is removed from its contact with the material in which it is embedded, the invention can be slipped down the shaft of the screwdriver to engage the screw and hold it securely when it is completely removed.

It should be understood that when the term "screw" is used, it is not intended to be limited to wood screws and that any screw, bolt, or other cylindrical mechanical piece which has threads may be used by the invention.

BRIEF DESCRIPTION OF PREFERRED EMBODIMENT

Figure 1:
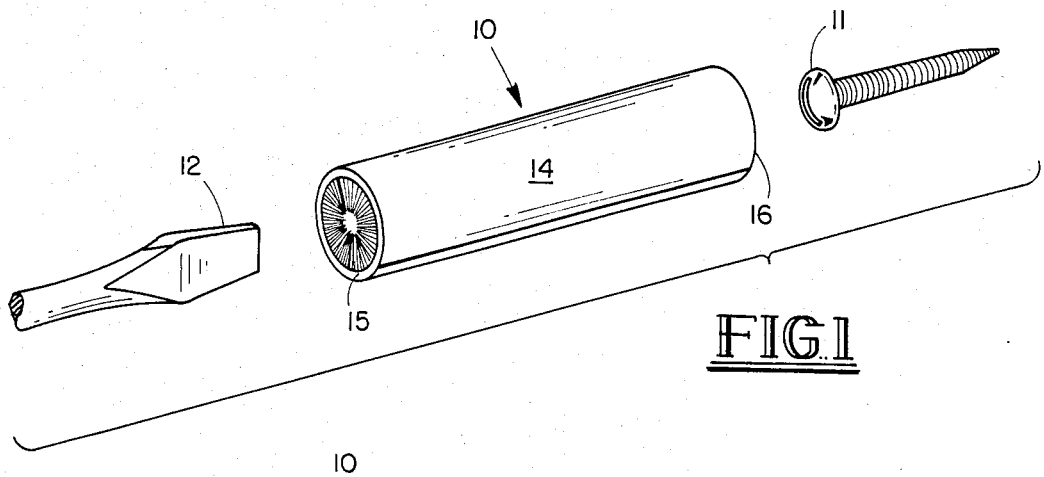
FIG. 1 is a perspective view showing the screw holding device of the invention along with a screw and a screwdriver.
Figure 3:
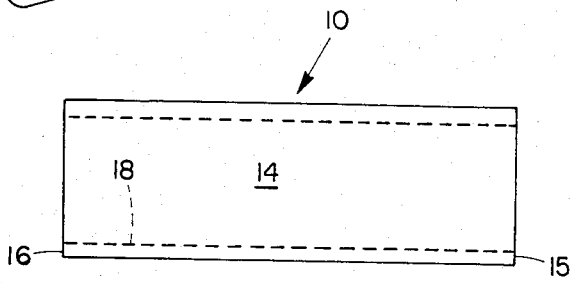
FIG. 3 is a side elevation view of the invention.
Figure 2:
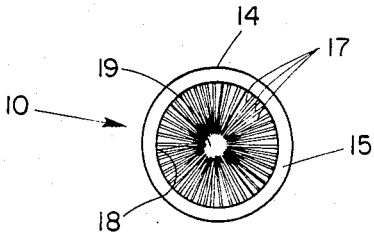
FIG. 2 is an end elevation view of the invention.
Figure 4:
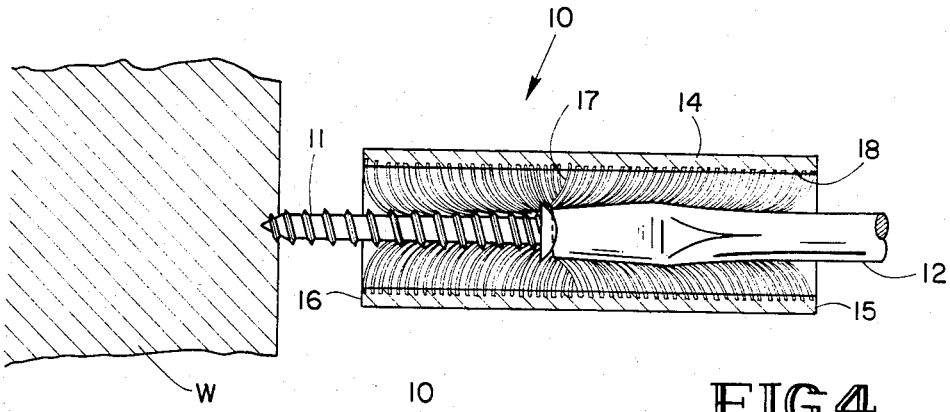
FIG. 4 shows the invention in position to start a screw.
Figure 5:
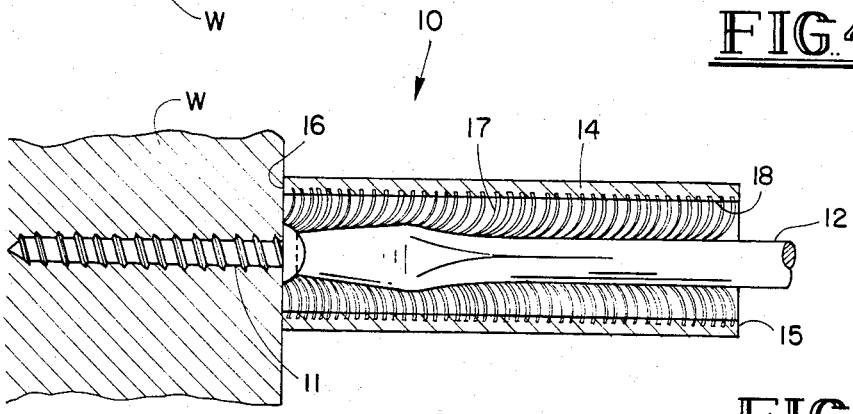
FIG. 5 shows the invention after the screw is driven into a work piece.

The screw holding apparatus 10 as shown in FIGS. 1, 2, and 3 will hold a screw, bolt, or other mechanical piece 11 in contact with the screwdriver 12 in position to be driven. As the screw 11 is driven as shown in FIGS. 4 and 5, the apparatus 10 will retract onto the shaft of the screwdriver 12.

The apparatus 10 will hold a screw, bolt, or similar mechanical piece of substantial variance in shape or length and will work with numerous size screwdrivers.

The apparatus may be made in a few sizes to fit a wide range of screwdrivers.

The apparatus itself, is a cylindrical tube 14 of clear non-opaque material, open at both ends 15 and 16, filled with a large number of small bristles 17 attached to the inner cylinder wall 18 along its entire length and oriented radially towards the center of the axis of the cylinder 14. The bristles 17 are sufficiently close together and made of a material sufficiently stiff to hold in place a screw inserted into one end of the cylinder. A small passageway 19 is formed by the termination of the ends of the bristles 17 to facilitate insertion of a screw and screwdriver. The diameter of the cylinder 14 and the stiffness of the bristles 17 is such that a screw can be easily inserted as shown in FIG. 4 and so that the screw is firmly held in place with a screwdriver or the like retained in the head or driving portion of the screw. The bristles may take the form of the hook portion of hook and loop fastening means sold under the brand name Velcro. The tube is preferably cylindrical but may include grip means on the outer surface. The grip means may include a roughened surface or square grip means.

The operation and use of the apparatus 10 is best shown in FIGS. 4 and 5. A screw 11 is inserted in the device through the passageway 19. The inner ends of the bristles 17 provide numerous contact points with the screw to hold it over a substantial portion of its length. Accordingly the screw is held along the center line of the device 11 due to the numerous contact points of the bristles. The screwdriver 12 is inserted so that the end of the screwdriver easily engages the head of the screw 11. The screw 11 is then positioned to engage the work piece W. Pressure is then applied to the end of the screwdriver and it is rotated to force the screw into the work piece W as shown in FIG. 5. Numerous bristles engage the screwdriver along its outer surface throughout the length of the screwdriver which is inserted into the apparatus 10. Accordingly the screwdriver is held in a centered position so that the end of the screwdriver will stay engaged with the head of the screw 11. After the screw 11 is completely driven into the work piece W, the ends of the bristles 17 will no longer grip the screw and the screwdriver and apparatus 10 may be removed. In order to start another screw, one need merely slip the apparatus 10 part way off of the screwdriver and insert another screw into it and then engage the screw with the screwdriver. The screwdriver then may be rotated relative to the apparatus 10 to position the screw so that the end of it sticks outwardly from the apparatus 10 as best shown in FIG. 4.

It is possible that in some instances one or more of the bristles may be caught between the head of the screw and the wood when the screwdriver is fully driven. In this event, the bristles at the end of the tube could be trimmed back for a distance approximately equal to one-half the length of the bristles.

Although the invention has been described in conjunction with the foregoing specific embodiment, many alternatives, variations and modifications will be apparent to those of ordinary skill in the art. Those alternatives and modifications are intended to fall within the spirit and scope of the appended claims.

I claim:

1. An apparatus to aid a person to drive a screw or to remove an embedded screw comprising:

a rigid cylindrical tube which is open at both ends and which is filled with a screw holding means on the inner cylindrical wall of the tube and oriented radially towards the center of the axis of the tube;

such screw holding means means including a large number of closely spaced small bristles sufficiently close together and made of flexible material stiff enough to provide numerous contact points with the screw to laterally hold it over its entire length within said tube to hold in place a driver and screw when the driver and screw are inserted into the tube for driving the screw and flexible enough to permit a driver and screw to be inserted from either end of the screw holding means;

the ends of the bristles forming a cylindrical passage extending through the tube for insertion of a screw and driver and said cylindrical passage being smaller than the driver and screw to maintain a hold on the driver and screw throughout their lengths within said tube; and said bristles extending along the entire length of said tube so that the driver and screw are held laterally by the bristles during driving of the screw.

2. The apparatus as set forth in claim 1, wherein:

the tube is constructed of a clear material so that the person driving the screw can see when the tip of the driver is in alignment with the head of the screw.

* * * * *